United States Patent [19]

Brewer et al.

[11] Patent Number: 5,037,492

[45] Date of Patent: Aug. 6, 1991

[54] ALLOYING LOW-LEVEL ADDITIVES INTO HOT-WORKED ND-FE-B MAGNETS

[75] Inventors: Earl G. Brewer, Warren; Carlton D. Fuerst, Royal Oak, both of Mich.

[73] Assignee: General Motors Corporation, Detroit, Mich.

[21] Appl. No.: 626,425

[22] Filed: Dec. 17, 1990

Related U.S. Application Data

[63] Continuation of Ser. No. 453,434, Dec. 19, 1989, abandoned.

[51] Int. Cl.[5] ..... H01F 1/02

[52] U.S. Cl. ..... 148/101; 148/104; 148/302; 419/12; 419/61; 419/65

[58] Field of Search ..... 148/101, 104, 105, 302; 419/12, 61, 65

[56] References Cited

U.S. PATENT DOCUMENTS 4,765,848 8/1988 Mohri et al. ..... 148/302

FOREIGN PATENT DOCUMENTS 0125752 11/1984 European Pat. Off. ..... 148/302

OTHER PUBLICATIONS

*Nd-Fe-B Die-Upset and Anisotropic Bonded Magnets (invited)*, Nozawa et al., J. Appl. Phys., 64 (10), Nov. 15, 1988.

*Coercivity Enhancement of Melt-Spun Nd-Fe-B Ribbons via Low-Level Transition Metal Substitutions*, Herbst et al., Research Disclosure No. 30409, Aug. 1989.

Rowlinson et al., "New Developments in Bonded Nd--Fe-B Magnets", Journal of Magnetism and Magnetic Materials, 80, (1989), 93-96, North-Holland, Amsterdam.

*Primary Examiner*—John P. Sheehan

*Attorney, Agent, or Firm*—George A. Grove

[57] ABSTRACT

Diffusion alloying techniques are used to introduce low level additives into hot-worked Nd-Fe-B magnets. The powdered metal is added to the rapidly solidifed ribbons of the magnetic alloy prior to hot working. Diffusion alloying during hot-working permits the final chemistry of the magnet and more specifically the grain boundaries to be determined during the final processing steps. Elements which diffuse into the matrix, such as zinc, copper and nickel, enhance the coercivity by as much as 100 percent in die-upset magnets. At optimum levels, approximately 0.5-0.8 weight percent, the additives did not diminish the remanence or energy product of the magnet.

6 Claims, 2 Drawing Sheets

ALLOYING LOW-LEVEL ADDITIVES INTO HOT-WORKED ND-FE-B MAGNETS

This is a continuation of application Ser. No. 07/453434 filed on Dec. 19, 1989, abandoned.

FIELD OF THE INVENTION

This invention relates to permanent magnetic alloys and a method for making these alloys. Particularly, this invention relates to permanent magnet alloys having high room temperature coercivity and to a method for forming such magnetic alloys wherein a powdered metal additive is added to rapidly solidified powders of neodymium, iron and boron.

BACKGROUND OF THE INVENTION

Rapidly solidified neodymium, iron, boron (Nd-Fe-B) alloys yield high performance, essentially isotropic, permanent magnet materials whose principal component is the tetragonal $Nd_2Fe_{14}B$ phase. The ribbons or flakes produced by rapid solidification, i.e., melt-spinning, may be hot-worked by isostatically pressing at elevated temperatures to produce fully dense, or hot-pressed, magnets with essentially the same magnetic properties as the original ribbons. With further processing, specifically die-upsetting, magnetically aligned magnets are produced with approximately 50 percent higher remanences ($B_r$) and approximately 200 percent higher energy products [$(BH)_{max}$] compared to the hot-pressed precursor material.

The process of magnetic alignment achieved during die-upsetting has been described as a diffusion slip mechanism which requires small grain sizes, approximately 50 nanometers, and a ductile grain boundary phase. The combination of small grain size and a ductile grain boundary phase allows an orientation of the c-axis of the grains to take place along the press direction during plastic deformation. Since the c-axis is also the preferred orientation of the magnetization, the magnetic properties are enhanced along the pressed direction of the die-upset magnets.

Larger grains are deleterious to the alloy since they do not respond as well as small grains to the strains induced during die-upsetting, and accordingly remain randomly oriented, lowering the remanence and energy product of the alloy. In addition, whether aligned or not, larger grains are also associated with lower coercivities in these materials. It is therefore desirable to use lower processing temperatures and shorter times at those temperatures to limit grain growth within the alloy during the hot-working steps.

Another approach to limiting grain growth is to introduce into the alloy impurities or additives which collect in the grain boundaries. If the additive is foreign to the 2-14-1 phase inside the grain it must migrate with the boundary as the grain grows, resulting in slower grain boundary movement, and thereby slowing grain growth.

Although relatively large concentrations, i.e., approximately 10 atomic percent, of a substituent are typically required in order to have a measurable effect on the intrinsic properties of the $Nd_2Fe_{14}B$ phase, much smaller additive levels, i.e., approximately 1 atomic percent, may have a substantial impact on the hard magnetic properties of a magnet. This is because the grain boundary phase, which plays a vital role in grain growth and domain wall pinning mechanisms, may be preferentially occupied by the additive creating a locally high concentration of that additive within the alloy.

Previous work has been performed on the effect of low-level additives in die-upset Nd-Fe-B magnets, where the composition of the magnets was given as $Nd_{14}Fe_{77}B_8M_1$. This previous work concluded that gallium, wherein M=Ga, provided the largest enhancement of the coercivity, approximately 21.1 kiloOersteds, as compared to the additive-free composition, wherein M=Fe, which had the lowest coercivity of approximately 7.6 kiloOersteds. Other additives have also enhanced the coercivity but to lesser degrees. However, the remanences reported for all these magnets were lower than that of the additive-free magnet, by as much as 15 percent.

At present, the state-of-the-art concludes that additives in the $Nd_2Fe_{14}B$-type magnets must be added into the alloy at the initial melting and casting of the ingot, prior to melt-spinning and hot-working. However, it would be desirable to introduce the additive into the magnetic alloy during the hot-pressing phase, therefore permitting the additive and its concentration to be adjusted during this final step. The relatively low temperatures used in hot-working compared to either melt-spinning or sintering, probably would help limit the additive to the neodymium-rich grain boundaries where they would most likely affect grain growth and therefore coercivity.

Thus, what is needed is a method for making permanent magnetic alloys wherein the additive is introduced into the alloy prior to the hot-working steps.

SUMMARY OF THE INVENTION

It is an object of the present invention to provide a $Nd_2Fe_{14}B$-type magnet.

It is a further object of this invention that such magnet be formed by a method wherein the metal additive is introduced into the magnet prior to the hot-working phase.

In accordance with a preferred embodiment of this invention, these and other objects and advantages are accomplished as follows.

We are the first to diffusion-alloy a metal additive into a magnetic alloy during hot-working, thus permitting the additive and its concentration, and correspondingly the magnetic properties, to be adjusted during this final processing step. The relatively low temperatures used in hot-working, as compared to other techniques, such as melt-spinning or sintering, helps limit the additives to the neodymium-rich grain boundaries where they are most likely to effect grain growth and thus coercivity. The elemental additives are introduced into the alloy by first stirring a fine powder of the additive into the crushed rapidly solidified ribbons prior to hot-pressing. Pure elements were used, however it is foreseeable that compounds may also be used, as well as other techniques for adding the additive such as plating or spraying techniques.

Eleven metal elemental additives have been determined to diffuse thoroughly through the Nd-Fe-B magnets thereby resulting in an alloy having homogeneous magnetic properties throughout: cadmium, copper, gold, iridium, magnesium, nickel, palladium, platinum, ruthenium, silver and zinc. Other elemental additives were also tested, however they tended to only diffuse over short distances (approximately 100 micrometers)

and/or react with the Nd-Fe-B matrix to form intermetallic phases.

A primary inventive feature of this invention is the diffusion alloying of zinc, in concentrations ranging from approximately 0.1 weight percent to approximately 10 weight percent, throughout the Nd-Fe-B magnets. Two other powdered additives; copper and nickel, both at approximately 0.5 weight percent, were also successfully diffusion alloyed into the Nd-Fe-B alloys with this technique. The resulting magnetic alloys are characterized by enhanced magnetic properties as compared to conventionally formed Nd-Fe-B magnets. For instance, the addition of these individual elements to the rapidly solidified ribbons enhanced the coercivity of the alloy by as much as 100 percent when the magnetic alloys were die-upset.

Other objects and advantages of this invention will be better appreciated from a detailed description thereof, which follows.

BRIEF DESCRIPTION OF THE DRAWINGS

The above and other advantages of this invention will become more apparent from the following description taken in conjunction with the accompanying drawings wherein.

DETAILED DESCRIPTION OF THE INVENTION

Figure 1A:
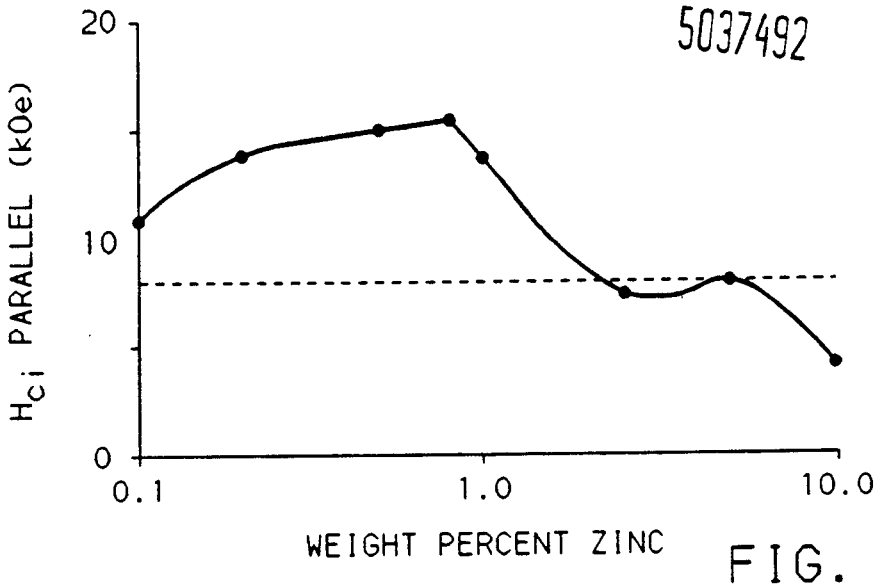
FIG. 1 illustrates various magnetic properties in relation to the weight percent zinc in die-upset Nd-Fe-B magnets.

Crushed ribbon flakes of rapidly solidified material having an approximate composition of $Nd_{13.7}Fe_{81.0}B_{5.3}$ were used as the starting material. The rapidly solidified ribbons were formed using conventional techniques wherein first a mixture is formed of neodymium, iron and boron, then the constituents are melted to form a homogeneous melt, and lastly the homogeneous mixture is rapidly quenched at a rate sufficient to form an alloy having a very fine crystalline microstructure. Hot-pressed magnets were formed from these ribbons by heating quickly to about 750°-800° C. in a vacuum and pressing isostatically at approximately 100 MegaPascals. Die-upset magnets were produced by pressing these hot-pressed precursors in an over-sized die at 750° C. until their original height was reduced by approximately 60 percent. Graphite dies were used in both hot-working steps, and boron nitride was used as a die-wall lubricant.

The magnets were sliced with a high speed diamond saw, yielding both (1) cross-sections for microscopy analysis and (2) 50 milligram cubes for demagnetization measurements on a vibrating sample magnetometer (VSM). All samples were premagnetized in a pulsed field of 120 kiloOersteds (kOe) and then measured with the VSM in directions parallel and perpendicular to the pressed direction. A self-demagnetization factor of one-third was used to correct for the geometry of the sample. Unless otherwise indicated, the values given throughout this specification for remanence ($B_r$), coercivity ($H_{ci}$) and energy product [$(BH)_{max}$] of the magnetic alloy will always refer to the direction parallel to the pressing. Densities of the alloys were also measured using the standard water displacement technique.

The powdered elemental additives used were characterized by a fine particle size, i.e., less than about 75 micrometers for zinc, less than about 45 micrometers for the copper and manganese, and less than about 10 micrometers for the nickel. The powdered elemental additives were individually added to the rapidly solidified and crushed Nd-Fe-B ribbons by weight. Therefore, for example, 1 weight percent zinc additive corresponds to a mixture containing about 1 weight percent powdered zinc and 99 weight percent crushed Nd-Fe-B ribbons.

Die-upset Nd-Fe-B magnets were formed from the hot-pressed precursors containing the various elemental additives as described by the method above. The densities and magnetic properties of die-upset, zinc-containing magnets are summarized in Table I.

TABLE I.

The density and magnetic properties of die-upset Nd—Fe—B magnets formed from hot-pressed Nd—Fe—B precursors containing diffusion-alloyed zinc. The magnetic properties were measured parallel and (perpendicular) to the press direction.

| Zinc wt % | Density g/cc | $B_r$ kG | $(BH)_{max}$ $MGO_e$ | $H_{ci}$ kOe |
|---|---|---|---|---|
| 0.0 | 7.57 | 12.1 (3.5) | 30.9 (2.3) | 7.9 (10.2) |
| 0.1 | 7.62 | 12.3 (3.4) | 34.1 (2.1) | 10.9 (9.8) |
| 0.2 | 7.60 | 12.2 (3.6) | 33.4 (2.5) | 14.0 (11.6) |
| 0.5 | 7.58 | 12.0 (3.6) | 32.4 (2.2) | 15.3 (11.2) |
| 0.8 | 7.57 | 11.9 (3.7) | 31.4 (2.6) | 15.8 (12.6) |
| 1.0 | 7.60 | 11.7 (4.1) | 30.6 (3.2) | 13.6 (12.8) |
| 2.5 | 7.58 | 11.5 (3.8) | 25.6 (2.6) | 7.4 (9.2) |
| 5.0 | 7.55 | 11.0 (4.2) | 22.4 (2.7) | 7.8 (7.7) |
| 10 | 7.56 | 9.2 (3.9) | 9.7 (0.8) | 3.7 (2.1) |

Figure 1B:
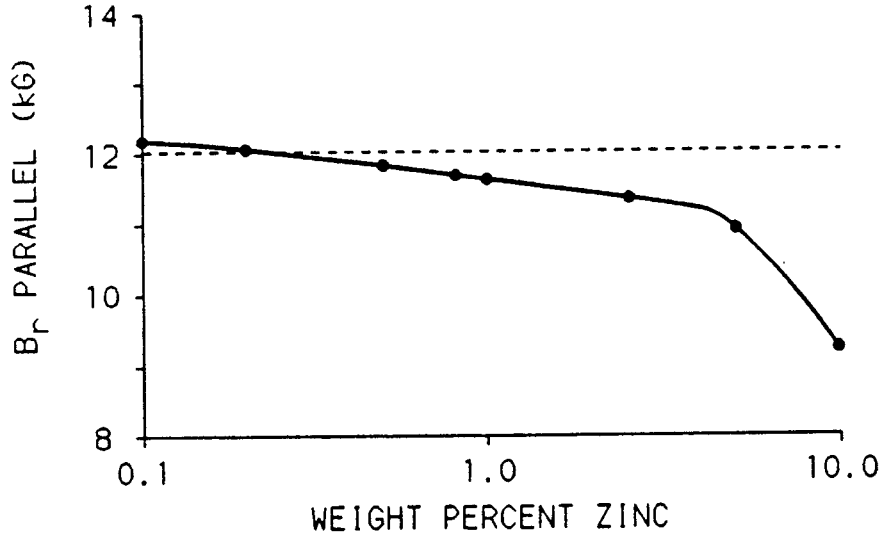
Figure 1C:
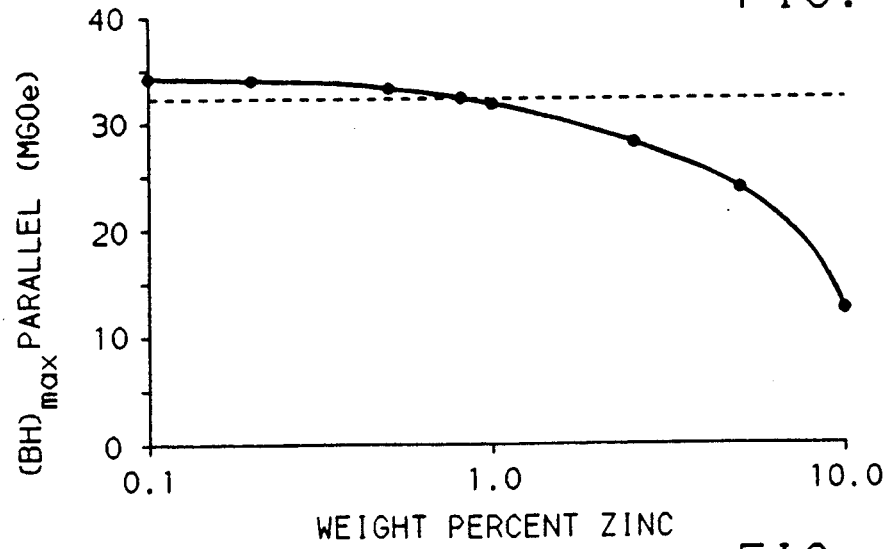
Figure 2A:
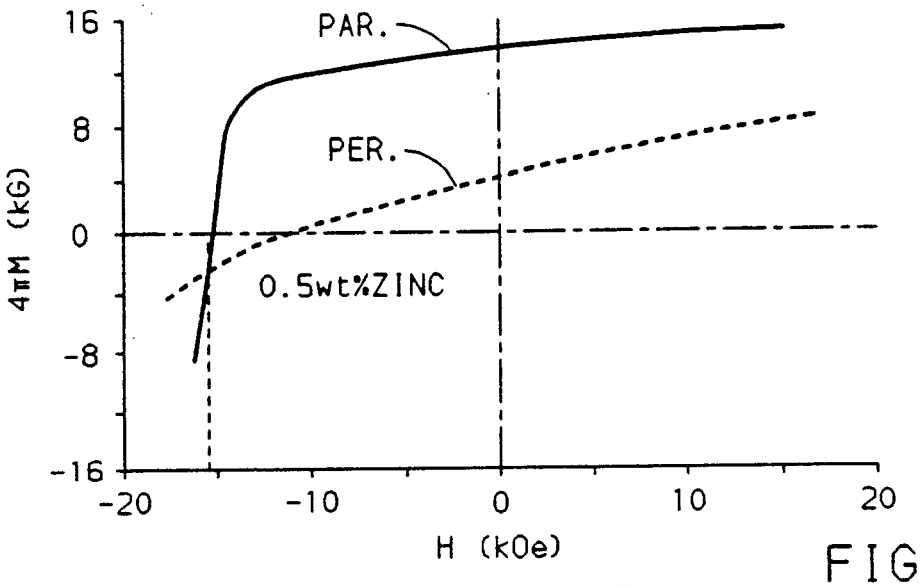
FIG. 2 illustrates the demagnetization curves for two die-upset magnets, (a) a Nd-Fe-B alloy containing approximately 0.5 weight percent zinc and (b) an additive-free Nd-Fe-B alloy, measured parallel and perpendicular to the press direction.
Figure 2B:
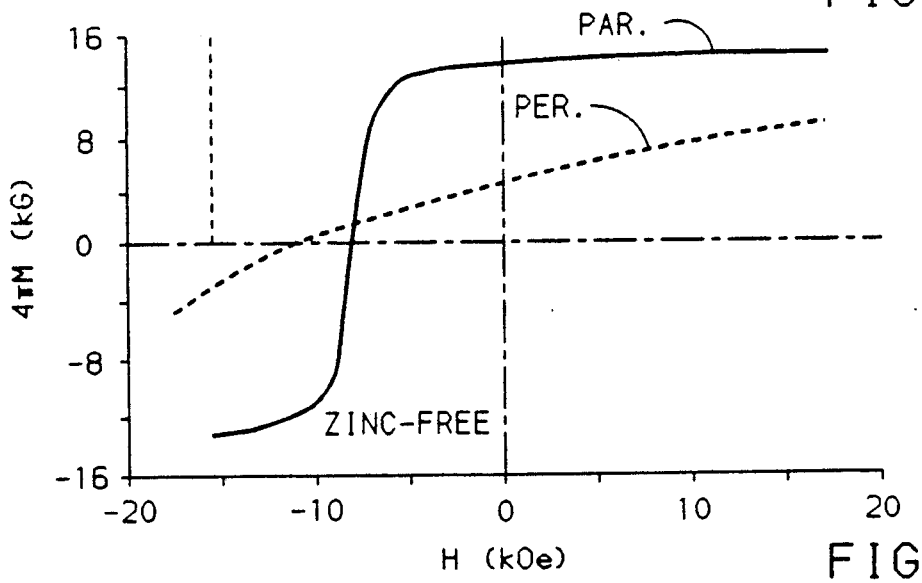

From the results tabulated in Table I, it is apparent that the optimum amount of zinc additive within the Nd-Fe-B precursors is about 0.5 to 0.8 weight percent, which corresponds to the results shown in FIGS. 1 and 2. FIG. 1 illustrates various magnetic properties versus weight percent zinc in die-upset Nd-Fe-B magnets. In particular, FIG. 1(*a*) shows coercivity ($H_{ci}$) vs. weight percent zinc; FIG. 1(*b*) shows remanence ($B_r$) vs. weight percent zinc; and FIG. 1(*c*) shows energy product [$(BH)_{max}$] vs. weight percent zinc. For comparison purposes, the corresponding magnetic properties of the zinc-free Nd-Fe-B magnet are indicated with dashed lines in each Figure.

As shown in FIGS. 1*a* and 1*b*, for the Nd-Fe-B magnets having approximately 0.5-0.8 weight percent zinc, the coercivities of 15.3 and 15.8 kOe respectively, were double that of the additive-free magnet, 7.9 kOe. At higher concentrations the gain in coercivity was reversed, and all magnetic properties deteriorated markedly with additions of approximately 10 weight percent zinc. The 0.5 weight percent zinc and zinc-free magnets have essentially the same remanence, Br=12 kG, and energy product, $(BH)_{max}$=31-32 MGOe.

In addition, as shown in FIG. 2, the knee of the demagnetization curve occurred at proportionally larger reverse fields in the zinc-containing magnets. FIG. 2 illustrates the demagnetization curves for die-upset Nd-Fe-B magnets. FIG. 1(*a*) containing about 0.5 weight percent zinc, and FIG. 1(*b*) being zinc-free. Measurements were made parallel (par.) and perpendicular (perp.) to the press direction. Again, for comparative purposes, a vertical dashed line is provided corresponding to the parallel direction coercivity measurement of the 0.5 weight percent zinc-containing Nd-Fe-B magnet.

Figure 3:
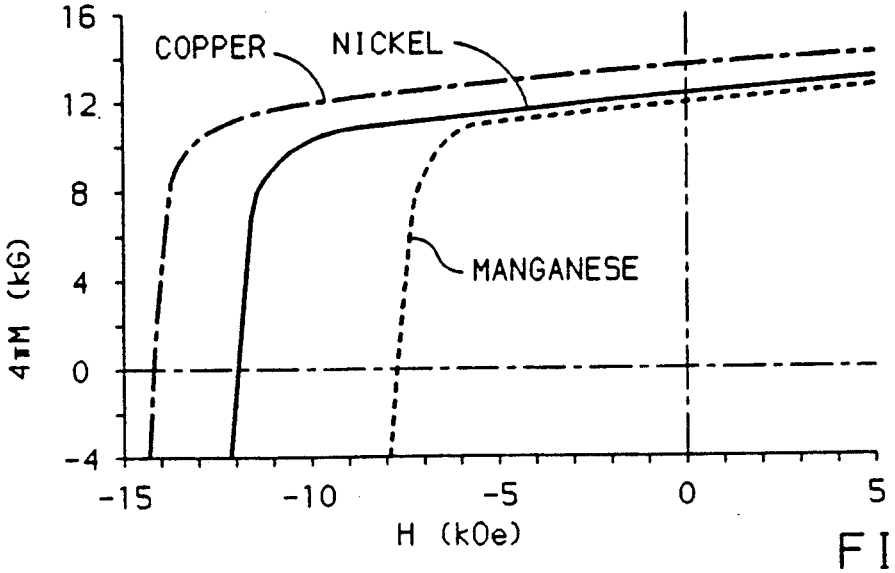
FIG. 3 illustrates the demagnetization curves for three die-upset Nd-Fe-B magnets each containing approximately 0.5 weight percent of an additive, measured parallel to the press direction.

FIG. 3 illustrates the demagnetization curves for three different die-upset Nd-Fe-B magnets each containing 0.5 weight percent of a different additive: copper (solid line), nickel (dashed line) and manganese (dotted line). Measurements were made parallel to the press direction. As with zinc, the addition of copper and nickel powders at approximately 0.5 weight percent, also increased the coercivity of the die-upset Nd-Fe-B magnet, to 14.0 and 12.1 kOe, respectively. In contrast manganese powder was also used as an additive, but had no measurable affect on the coercivity, $H_{ci}=7.6$ kOe. The copper-containing magnet had a larger remanence, $B_r=12.7$ kG, than magnets containing zinc, nickel or manganese wherein the remanence equaled approximately 12 kG. However this was most likely due to variations in press conditions and not the additive.

To locate the position of the added elements within the Nd-Fe-B magnetic alloy, electron microprobe analysis was used to examine the polished surface of the hot-worked samples containing approximately 0.5 weight percent zinc, copper, nickel and manganese. It was determined that nearly all of the zinc powder had reacted with the ribbon matrix. However, some of the zinc was present within an inter-ribbon, or grain boundary phase, with an approximate composition of $Zn_4Nd_{31}Fe_{65}$. The zinc may also have been present in other less obvious intermetallic phases within the boundary regions. However most of the zinc diffused into the ribbons, or grains, themselves. Yet, due to the small quantity of additive, the ribbons, or grains, are believed to be primarily made up of the tetragonal $Nd_2Fe_{14}B$ phase.

Copper and nickel diffused throughout the magnet in a manner similar to zinc. However, the diffusion of manganese, approximately 0.5 weight percent, was limited to a region within 10014 200 micrometers of the original grains of powdered additive. Without the ability to diffuse, manganese was less able to influence the coercivity of the magnet.

Zinc levels varied from ribbon to ribbon and showed a strong correlation with neodymium levels. Zinc was more concentrated in ribbons which were also richer in neodymium. The variation in neodymium concentrations was probably due to production processes since this pattern was also observed in the zinc-free magnet. It is presumed that the zinc diffused into the intergranular boundaries within the ribbons which are neodymium-rich, and since neodymium-rich ribbons should have a greater volume percent of this boundary phase, a greater percentage of the zinc would collect in these ribbons.

It should be noted that gallium, which has resulted in the largest coercivity enhancement when added to an ingot, was difficult to obtain and handle as a powder because of its low melting temperature. However, initial tests with a coarse gallium powder revealed that although it diffused into nearby ribbons, the bulk of the gallium was tied up as intermetallic phases, and just as with the manganese, adding the gallium did not alter significantly the coercivity.

Diffusion alloying has been shown to be an effective process of introducing low-level additives into hot-worked Nd-Fe-B magnets. Although similar coercivities have been previously obtained adding elements to the initial ingot, diffusion alloying during hot-working permits the final chemistry of the magnet and, more specifically, the grain boundaries to be determined during the final processing steps. Elements which diffuse into the matrix, such as zinc, copper and nickel, enhance the coercivity by as much as 100 percent in die-upset Nd-Fe-B magnetic alloys. The coercivity was less affected by elements which did not diffuse readily such as manganese. At optimum levels, approximately 0.5–0.8 weight percent, the additives did not diminish the remanence or energy product of the alloy.

While our invention has been described in terms of preferred embodiments, it is apparent that other forms could be adopted by one skilled in the art, such as by substituting compound powder additives for elemental powder additives, or by substituting any of the eleven elements believed to diffuse thoroughly through the Nd-Fe-B magnetic alloys, i.e., cadmium, copper, gold, iridium, magnesium, nickel, palladium, platinum, ruthenium, silver and zinc, or by modifying the heating and processing temperatures to promote diffusion within the grain boundaries of the alloy. In addition, it is foreseeable that other methods may be used to introduce the additive into the rapidly solidified Nd-Fe-B alloy, such as by using wet chemical plating techniques which would result in homogeneous ionic deposition of the additive on the surface of the individual ribbons, or by plasma or metal spraying techniques. Accordingly the scope of our invention is to be limited only by the following claims.

The embodiments of the invention in which an exclusive property or privilege is claimed are defined as follows:

1. A method for making an alloy with permanent magnetic properties at room temperature by melting a mixture of neodymium, iron and boron to form a homogeneous melt, rapidly quenching said homogeneous melt at a rate sufficient to form ribbons of an alloy having a very fine crystalline microstructure, heating said alloy to a temperature between about 750° C. and 800° C., and applying pressure to said heated alloy to consolidate it to near full density;

wherein the improvement comprises mixing said ribbons of said alloy with up to about 1.0 weight percent of elemental zinc prior to said heating step.

2. A method for making an alloy with permanent magnetic properties at room temperature as recited in claim 1, wherein said amount of zinc ranges between about 0.5 to about 0.8 weight percent.

3. A method for making an alloy with permanent magnetic properties at room temperature by melting a mixture of neodymium, iron and boron to form a homogeneous melt, rapidly quenching said homogeneous melt at a rate sufficient to form ribbons of an alloy having a very fine crystalline microstructure, heating said alloy to a temperature between about 750° C. and 800° C., and applying pressure to said heated alloy to consolidate it to near full density;

wherein the improvement comprises mixing said ribbons of said alloy with up to about 1.0 weight percent of elemental copper prior to said heating step.

4. A method for making an alloy with permanent magnetic properties at room temperature as recited in claim 3 wherein said amount of copper is up to about 0.5 weight percent.

5. A method for making an alloy with permanent magnetic properties at room temperature by melting a mixture of neodymium, iron and boron to form a homogeneous melt, rapidly quenching said homogeneous melt at a rate sufficient to form ribbons of an alloy having a very fine crystalline microstructure, heating said alloy to a temperature between about 750° C. and 800° C., and applying pressure to said heated alloy to consolidate it to near full density;

wherein the improvement comprises mixing said ribbons of said alloy with up to about 1.0 weight percent of elemental nickel prior to said heating step.

6. A method for making an alloy with permanent magnetic properties at room temperature as recited in claim 5 wherein said amount of nickel is up to about 0.5 weight percent.

* * * * *